United States Patent [19]

Flanders

[11] 4,274,639

[45] Jun. 23, 1981

[54] EXERCISE AND GAME APPARATUS

[76] Inventor: Ralph W. Flanders, 19726 Rolling Acre, South Bend, Ind. 46614

[21] Appl. No.: 63,248

[22] Filed: Aug. 2, 1979

[51] Int. Cl.[3] ..... A63B 63/08; A63B 21/00; A63H 33/22

[52] U.S. Cl. ..... 273/402; 273/1 R; 273/412; 273/414; 273/DIG. 19; 46/49; 272/119

[58] Field of Search ..... 273/402, 398–401, 273/412, 414, DIG. 19, 1 R, 1 E; 46/47, 48, 49, 50, 51, 43; 272/123, 128, 117, 119

[56] References Cited

U.S. PATENT DOCUMENTS

| | | | |
|---|---|---|---|
| D. 239,648 | 4/1976 | Somsky | 273/DIG. 19 X |
| 1,535,502 | 4/1925 | Southwell | 46/50 |
| 2,592,286 | 4/1952 | Jacobs | 46/49 |
| 3,039,228 | 6/1962 | Mazzadra | 46/47 |
| 3,110,497 | 11/1963 | Broman et al. | 273/DIG. 19 X |
| 3,178,851 | 4/1965 | Gage | 273/DIG. 19 X |
| 3,610,622 | 10/1971 | Haroski | 273/DIG. 19 X |
| 3,679,204 | 7/1972 | Busby | 46/47 X |
| 3,703,049 | 11/1972 | Beaubien | 46/47 |
| 3,762,086 | 10/1973 | Horbinski | 46/47 X |

*Primary Examiner*—Paul E. Shapiro
*Attorney, Agent, or Firm*—Marmaduke A. Hobbs

[57] ABSTRACT

An exercise and game apparatus in which a ball having shafts attached thereto is rotatably mounted by the shafts within a hoop. Two attachment bars extend diametrically outwardly from the hoop and are secured to devices on belts around two people using the apparatus. Handles on the bars are provided to assist in steadying the apparatus as a revolving movement of the person's hips causes the ball to spin within the annular ring. Baskets may be provided on the attachment bars so that the people using the device can throw a ball back and forth, attempting to throw the ball into the basket on the opposite side of the hoop while continuing the hip movement necessary to keep the ball spinning.

8 Claims, 4 Drawing Figures

EXERCISE AND GAME APPARATUS

Doctors and health specialists have long advised people to engage in some form of physical activity, in that even seemingly insignificant activity can be very beneficial to the overall health status of the person. Many people do not participate in a regularly scheduled physical activity or exercise program, and, to many people, calisthenics and the like quickly become routine and boring, and therefore are not performed with any regularity. It is well known that people will more willingly engage in exercise or physical activity which is fun, enjoyable and challenging. When physical exercise becomes a game, people do it for fun and enjoyment; hence, much less self motivation is required. Devices and apparatus are often all that is needed to convert physical exercise into a game which has an objective other than the mere physical benefit. Hence, such devices as the hula hoop, frisbee and the like have achieved substantial popularity. Also, exercise which can be done by two people simultaneously has proven to be more popular than individual activity, especially if an element of competition is involved in the activity. This is evidenced by the popularity of games such as croquet, badminton, tennis and the like. The device or apparatus also serves as a gauge by which a person can measure his improvement through continued use. This, too, will encourage continued participation in the activity, as the participant can see improvement and is encouraged and challenged thereby to do even better.

Many of the same characteristics which make a game or exercise apparatus popular for adults also make such a device popular for use by children. Again, a device which can be used by two children and which involves a competitive element will help maintain interest in using the device. If bright colors, moveable parts and the like are incorporated in the device, a certain amount of visual stimulation or engrossment is also involved, thereby maintaining the child's attention and interest in using the device. It is also desirable in designing exercise and game apparatus for children to include an educational element in the device so that in addition to providing a game or toy for the child, there are also educational or physical training benefits derived from the use thereof. The development of motor and coordinative skills is encouraged by apparatus which require the simultaneous and repetitive movement of portions of the body while the participators are performing seemingly disassociated movements of limbs or other body parts.

Few apparatus in the past have combined more than several of the aforementioned characteristics. Many of the game type activities require large areas in which to engage in the activity and/or special equipment and facilities such as tennis courts and the like. Similarly, few apparatus have been designed so that children and grown-ups can compete on a relatively equal competitive level. What is challenging for a child quite often is routine and easy for an adult, hence discouraging simultaneous participation by parents and their children.

It is therefore one of the principal objects of the present invention to provide an exercise and game apparatus which is equally entertaining for children and adults, both male and female, and permits participation by adults and children on a relatively equal basis, and which, during the use thereof, will provide some of the benefits of physical exercise, thereby being both an entertainment activity and a health aid.

Another object of the present invention is to provide an exercise and game apparatus which makes physical activity enjoyable, entertaining and challenging, and will therefore encourage continued use of the apparatus, and which has a visually entertaining appearance and movement during its operation, as well as a feature by which the user can measure his improvement, thereby further engrossing the user and encouraging participation and use of the apparatus.

A further object of the present invention is to provide an exercise and game apparatus which can be used by one person alone or can be used by two people simultaneously, and which, when used by two people, has a competitive feature which again will further encourage use and will maintain interest in using the device.

A still further object of the present invention is to provide an exercise and game apparatus which can be used as a toy for children and will entertain children for long periods of time, and which will help develop motor and coordinative skills in children.

Further objects and advantages of the present invention will be apparent from the following detailed description and accompanying drawings wherein.

Figure 1:
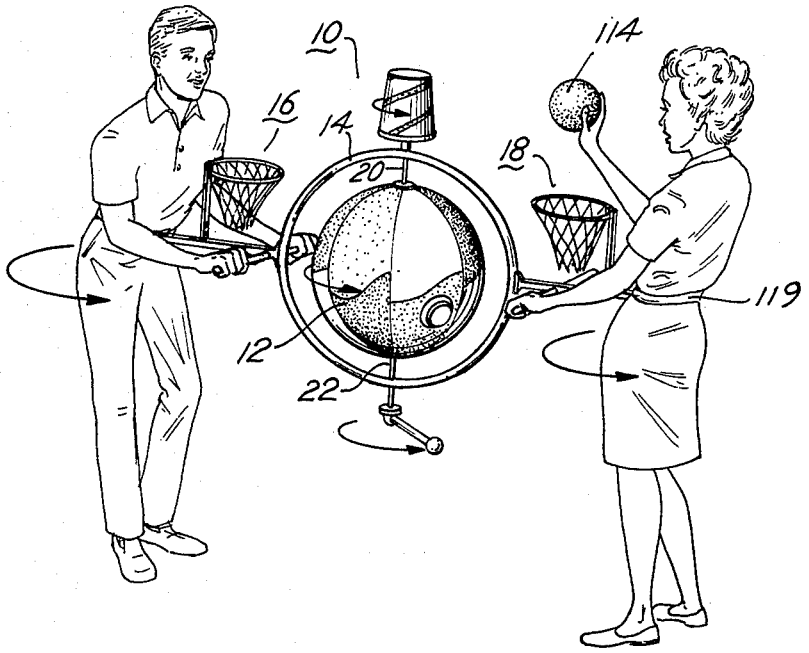
FIG. 1 is a perspective view of the present exercise and game apparatus, showing two people using the apparatus.
Figure 2:
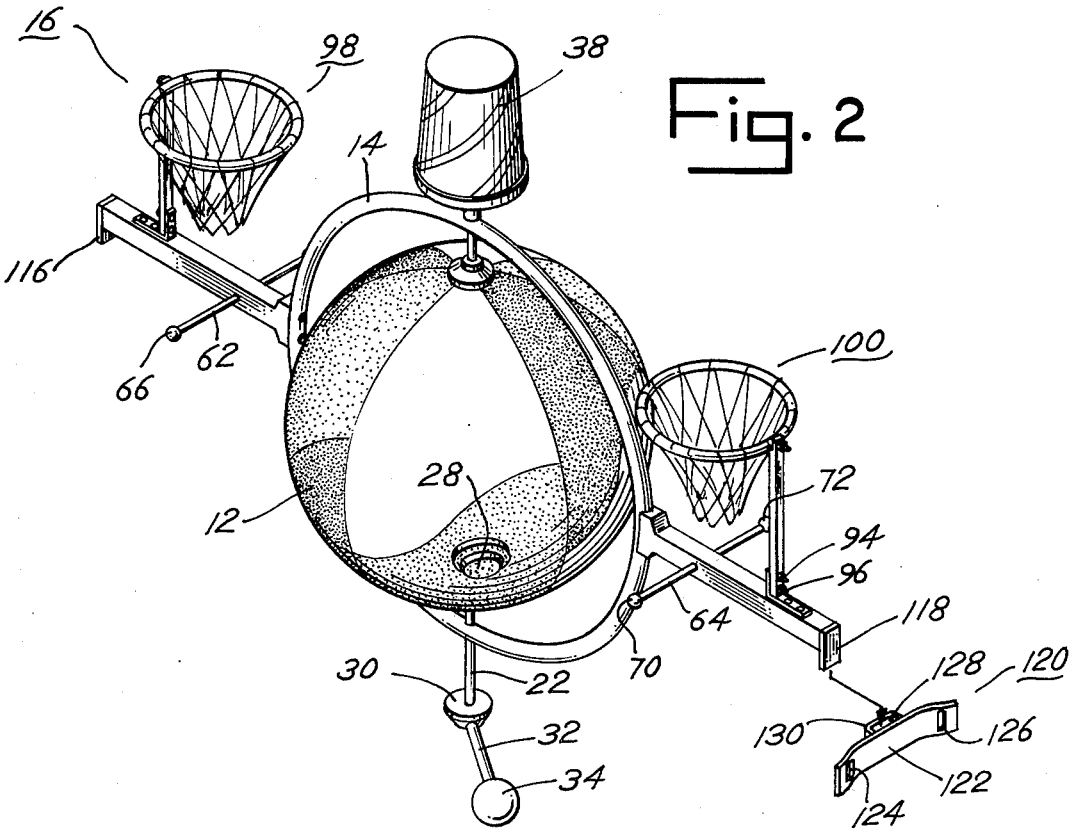
FIG. 2 is a perspective view of the exercise and game apparatus shown in FIG. 1.
Figure 3:
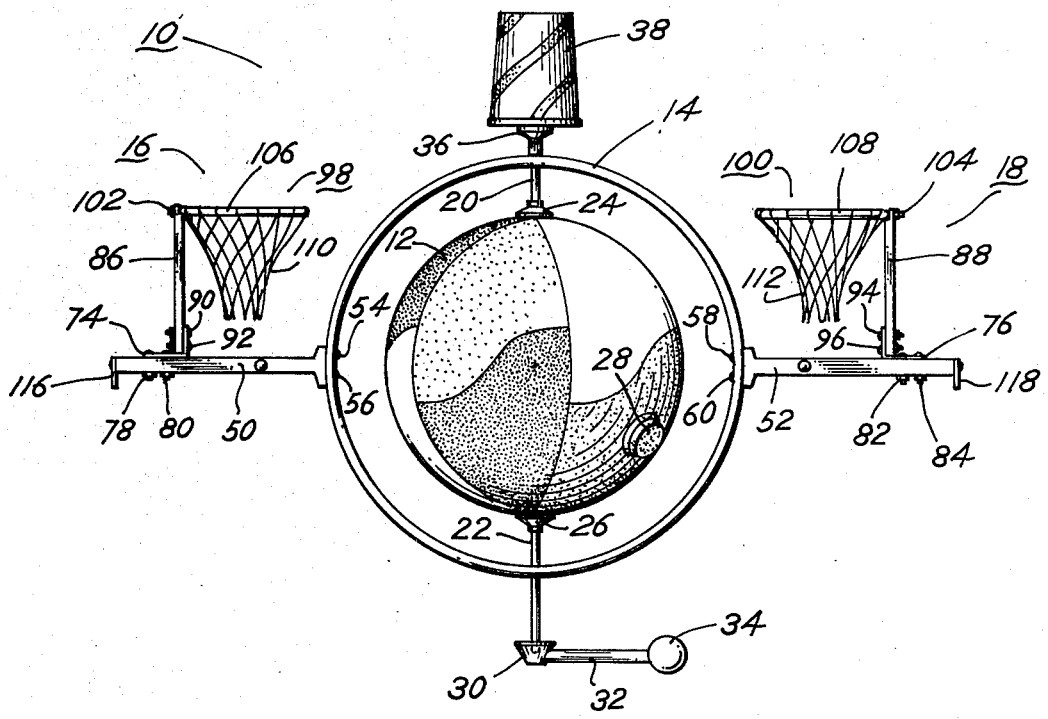
FIG. 3 is a side elevational view of the exercise and game apparatus.
Figure 4:
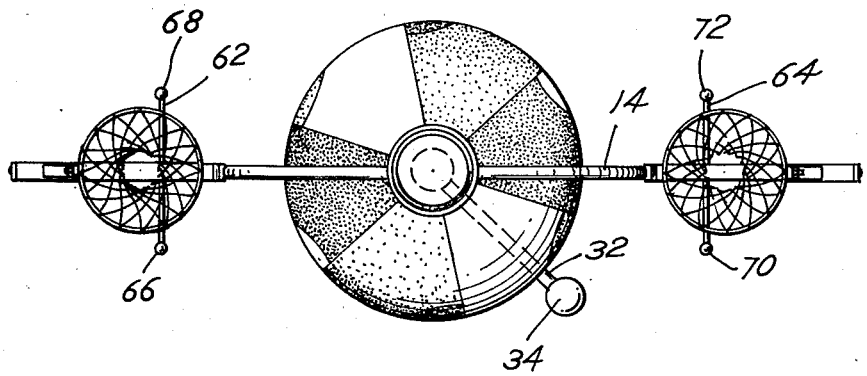
FIG. 4 is a top plan view of the exercise and game apparatus.

Referring more specifically to the drawings, and to FIG. 1 in particular, a man and woman are shown utilizing an exercise and game apparatus embodying the present invention designated generally by numeral 10. An inflatable ball 12 is rotatably mounted on its vertical axis within a hoop 14 of sufficient internal diameter to permit ball 12 to rotate freely therein. Diametrically opposed competitor assemblies 16 and 18 extend radially outwardly from hoop 14 and are shown in FIG. 1 to be attached to the man and woman, respectively. Inflatable ball 12 can be of any suitable inflatable material such as is commonly used for beach balls and the like, and may have a plurality of colors forming various geometric shapes on the surface thereof to provide colorful visual appearances and optical illusions as ball 12 rotates when apparatus 10 is being used.

Ball 12 is mounted within hoop 14 by upper and lower shafts 20 and 22 which are secured to collars 24 and 26 mounted on ball 12 and which extend through hoop 14. Shafts 20 and 22 are rotatable within hoop 14 but are secured rigidly to collars 24 and 26 so that as ball 12 spins, the shafts will also spin. A weight 28 is disposed on the surface of ball 12 at a position below the horizontal axis of the ball, and, through a revolving body movement by the competitors, causes the ball to spin, as will be described hereinafter. A collar 30 on lower shaft 22 has a radially extending rod 32 on which a weighted ball 34 is disposed. For proper and efficient operation of the exercise and game apparatus, weighted ball 34 and weight 28 should be vertically linear in location. A collar 36 is disposed on shaft 20 and rests on hoop 14 for centering the ball in the hoop, the collar preferably having secured thereto a decorative top 38 which may have a variety of colors, patterns and shapes to also provide a pleasing visual appearance as it spins with shaft 20. In the embodiment shown, a barber pole striping has been used on top 38, but other patterns are also suitable.

Competitor assemblies 16 and 18 are diametrically opposed and extend radially outwardly from the horizontal axis of hoop 14. Bars 50 and 52, of wood or plastic, are attached to hoop 14 by screws 54 and 56 for bar 50 and screws 58 and 60 for bar 52. Extending through bars 50 and 52 are rods 62 and 64 which the competitors may grasp to stabilize the apparatus and which have knobs 66 and 68 on rod 62 and knobs 70 and 72 on rod 64, to prevent the competitors' hands from slipping off the ends of the rod. Brackets 74 and 76 are attached to bars 50 and 52 by bolts 78 and 80, and 82 and 84, respectively, and vertical support members 86 and 88 are attached to the vertical portions of brackets 74 and 76 by bolts 90, 92, 94 and 96. Baskets 98 and 100, secured to the upper ends of vertical support members 86 and 88 by bolts 102 and 104, consist of rings 106 and 108 and nets 110 and 112, respectively. The bottom ends of nets 110 and 112 are enclosed, so that a ball 114, such as that shown being held by the woman in FIG. 1, will be caught therein. The ball is tossed between competitors, who are attempting to throw the ball through rings 106 or 108 where it will be caught and held by nets 110 and 112. Attachment plates 116 and 118 are disposed on the ends of bars 50 and 52 and are secured in attachment devices 120 on each competitor, shown at numeral 119. Attachment device 120 is a curved plastic or metal piece 122 having slots 124 and 126 disposed therein through which the belt may be threaded. On the front of device 120, a receiving slot 128 is formed by a channel piece 130 secured to piece 122 and is located to receive an attachment plate 116 or 118 from either of the competitor assemblies, thereby securing apparatus 10 to the competitors.

In the use and operation of an exercise and game apparatus embodying the present invention, each competitor secures an attachment device 120 to his waist by threading a belt through slots 124 and 126 of device 120. The attachment plates 118 are inserted in slot 128 of device 120 on each competitor, thereby securing apparatus 10 to the competitor, and when both of the competitors are secured in this manner, each grasps rod 62 or 64 on his side to steady the apparatus. Circular hip rotation or gyrations will create a circular or elliptical orbital movement of the apparatus between the competitors. Weight 28 on ball 12 and weighted ball 34 on rod 32 initially follow the movement of the apparatus; however, due to the pivotal mounting of shafts 20 and 22 in hoop 14, the weighted elements continue in the direction of their initial movement and react belatedly to the changes in direction of movement of the competitors. Weight 28, on the outer surface of ball 12, causes the ball to be off balance, having a balance point different from the rotational axis, which is the same axis as shafts 20 and 22. Weighted ball 34 on the end of rod 32 further adds to the disparity between the balance point and the rotational axis. Hence, as ball 12 spins, the balance point, which is essentially the position of weight 28 and weighted ball 34, moves in a circular path around the rotational axis, and, at any point of that path, the directional force of the weighted elements is tangential to the path of movement. The centrifugal force from the fixed rotational axis tends to "pull" the ball around its rotational axis at a consistent or accelerated velocity. Shafts 20 and 22, and all parts secured thereto, spin as indicated by the arrows shown in FIG. 1. Once a fluid hip movement has been established, ball 12 will spin within hoop 14, and top 38, being secured to shaft 20, will spin therewith, as will collar 30 on lower shaft 22. The two weighted portions, 28 on ball 12 and 34 on shaft 32, tend to keep ball 12 spinning smoothly and evenly by increasing the momentum of the movement due to the increased weight of the moving parts and the centrifugal force involved therewith. Once the movement has been established and ball 12 is spinning consistently, the competitors may begin tossing ball 114 back and forth, attempting to score points by throwing the ball into basket 98 or 100. In order to keep ball 12 spinning, they must maintain the circular hip rotation as they attempt to throw the ball into the basket. Tossing the ball, while continuing to rotate the hips to keep ball 12 spinning, aids in the development of coordination. The score can be kept as to how many baskets each competitor makes and thereby use of this apparatus can have a "winner" and a "loser". This competitive aspect increases the desire to use the present apparatus. As one continues to use the apparatus, a higher level of expertise in performance of the coordinated acts will develop, and the realization of achievement of the higher performance level also encourages continued use. Developing the rhythmic hip rotation necessary to cause ball 12 to spin at a desired speed is also challenging and maintains a high interest level in utilizing the apparatus.

The exercise and game apparatus of the present invention can also be used by one person. When used individually, the object of performance is to cause ball 12 to spin by the proper hip rotation. Faster and smoother rotation of the hips will cause the ball to spin more rapidly within hoop 14, and the development of increased speed provides a self inducement for continued use of the device. Such bodily movements of the hips and waist can be very beneficial in keeping the waist trim, and the apparatus provides a more interesting objective and incentive to exercise than simple hip rotation exercises do.

The colors and design of ball 12 and top 38 make the device especially interesting to children. As the ball and top spin, the colors and patterns blend to form optical illusions of color changes which are intriguing to children. The rhythmic hip rotation necessary to operate the apparatus provides a motor skill developing exercise for children. When coupled with attempts to toss ball 114 into the basket on the opposite side, a challenging and coordination developing exercise results. The apparatus of the present invention can be utilized without top 38; however, besides the colorful aspects, the top provides for a more challenging basket shooting situation, as the ball must be tossed higher to clear top 38 on the flight to the basket on the opposite side. The apparatus also may be utilized without rod 32 and weighted ball 34, since weight 28 alone can maintain rotation of ball 12; however, the increased weight supplied by weighted ball 34 makes rotation of ball 12 more consistent and tends to keep ball 12 spinning at selected speeds. It is not essential that hoop 14 be circular and it may be of any other shape which will permit ball 12 to spin therein. An apparatus for use by one person can have a hoop or other supporting structure, such as a rectangular or U-shaped frame, extending from shaft 20 to shaft 22 on only one side of ball 12 and only one bar for the attachment as previously described extending therefrom. Further, the use of belt 119 is not essential, in that the device can be manipulated to rotate the ball by movement of the arms while the apparatus is held in the hand, or by movement of the body while the apparatus is held against the person's body by pressure applied by the hands. Ball 114 can have a cord or other type of tether, preferably connected to both baskets so that when a basket, is missed the ball can be easily retrieved. For storage, ball 12 can be deflated and the attachment bars can be removed from hoop 14.

It can be seen that the apparatus of the present invention is equally challenging to both adults and children and can therefore be used by both in competing against each other. The skills necessary to operate the apparatus efficiently can be developed by young and old alike, with neither having a competitive advantage merely because of age or physical development. Family challenges in mastering the use of the apparatus provide an even level of competition for competitors of different age groups.

Although one embodiment and several modifications have been described in detail herein, various other changes may be made without departing from the scope of the present invention.

I claim:

1. An exercise game apparatus comprising a ball, shaft means extending outwardly from said ball and forming a rotational axis for said ball, a hoop-like supporting structure for said ball and said shaft means, a weight means connected to said ball and offset from the rotational axis thereof for causing said ball to spin as said ball is moved in an orbital manner, a means including a bar connected to said hoop-like ball supporting structure and extending outwardly therefrom for use in manipulating the apparatus, a fastening portion at the end of said bar means for attachment to a belt, and a handle extending outwardly from said bar means for steadying said apparatus.

2. An exercise and game apparatus as defined in claim 1 in which two of said manipulating bar means are diametrically opposed to each other on said hoop-like structure.

3. An exercise and game apparatus as defined in claim 2 in which said shaft means is connected to said ball for rotation therewith, and said weight means includes an arm extending radially outwardly from said shaft means and a weight on said arm.

4. An exercise and game apparatus as defined in claim 2 in which a support extends upwardly from each of said bar means, a ring is attached to each of said supports and a net is attached to each of said rings for receiving a ball thrown into said ring.

5. An exercise and game apparatus as defined in claim 1 in which said weight means includes a weight on the side of said ball.

6. An exercise and game apparatus as defined in claim 1 in which said shaft means is connected to said ball for rotation therewith, and said weight means includes a weight on the side of said ball, an arm extending radially outwardly from said shaft means and a weight on said arm vertically linear with respect to said weight on said ball.

7. An exercise and game apparatus as defined in claim 1 in which a device has slots therein through which a belt can be threaded, and a channel for receiving said fastening portion.

8. An exercise and game apparatus as defined in claim 1 in which said ball contains areas of different colors for providing unique visual appearances when said ball spins.

* * * * *